United States Patent [19]

Hansen

[11] Patent Number: 4,494,500

[45] Date of Patent: Jan. 22, 1985

[54] ROTARY VALVE ASSEMBLY

[75] Inventor: Craig N. Hansen, Minnetonka, Minn.

[73] Assignee: Hansen Engine Corporation, Minnetonka, Minn.

[21] Appl. No.: 383,511

[22] Filed: Jun. 1, 1982

[51] Int. Cl.[3] ..... F01L 7/16

[52] U.S. Cl. ..... 123/190 E; 123/190 BD; 123/80 BB

[58] Field of Search ..... 123/80 R, 80 BB, 80 D, 123/80 DA, 190 R, 190 BD, 190 D, 190 E

[56] References Cited

U.S. PATENT DOCUMENTS

| | | | |
|---|---|---|---|
| 1,292,597 | 1/1919 | Gill | 123/190 D |
| 1,651,207 | 11/1927 | Hodges | 123/190 DL |
| 1,733,946 | 10/1929 | DeMeester, Jr. | 123/190 BF |
| 2,017,196 | 10/1935 | Anglada et al. | 123/59 AC |
| 2,222,059 | 11/1940 | Monleone | 123/80 DA |
| 3,039,448 | 6/1962 | Stucke | 123/59 AD |
| 3,130,953 | 4/1964 | Carpenter | 123/190 D |
| 3,395,680 | 8/1968 | Brooks | 123/78 R |
| 4,404,934 | 9/1983 | Asaka et al. | 123/190 E |

FOREIGN PATENT DOCUMENTS

| | | | |
|---|---|---|---|
| 401985 | 11/1933 | United Kingdom | 123/190 D |

*Primary Examiner*—Parshotam S. Lall
*Assistant Examiner*—W. R. Wolfe
*Attorney, Agent, or Firm*—Burd, Bartz & Gutenkauf

[57] ABSTRACT

A head for an internal combustion engine has a rotary valve for controlling intake and exhaust gas from the combustion chamber of a piston-type internal combustion engine. The valve has a continuous ceramic sleeve having an intake port, an exhaust port, and ignition hole. Rotatably disposed within the sleeve is a rotatable ceramic ring having a valving port open to the combustion chamber. The sleeve is rotatable by a driven body to sequentially align the valving port with the intake port, ignition hole, and exhaust port during the operation of the engine.

29 Claims, 15 Drawing Figures

ROTARY VALVE ASSEMBLY

FIELD OF INVENTION

The invention pertains to a rotary valve assembly usable with an internal combustion engine, fluid motor, or gas compressor to control the flow of intake and exhaust gas.

BACKGROUND OF INVENTION

Rotary valves have been proposed for use with internal combustion engines. These valves have valving members drivably connected to the crankshafts of the engines to sequentially allow intake gas, such as an air and fuel mixture, to flow into the engine and exhaust gas to flow out of the engine. An example of a rotary valve mechanism for an internal combustion engine is described by Carpenter in U.S. Pat. No. 3,130,953. This valve mechanism has a rotary valve body rotatably located in a head. The head is mounted atop a cylinder. A self-sealing split sleeve device associated with the body functions as a valving member and seal. The sleeve is a metal cylindrical member having a hole and a longitudinal split. In use the sleeve deforms outwardly into surface sealing engagement with an inside cylindrical wall of the head to close the intake and exhaust ports.

Ceramic materials have been developed for parts of turbine engines and internal combustion engines. Engine designs must accommodate the mechanical, heat, and lubricating characteristics of the ceramic materials. The rotary valve assembly of the present invention has ceramic parts that are compatible with the material of the head, cylinder, and piston of the engine.

SUMMARY OF INVENTION

The invention is directed to a rotary valve assembly and a head for an apparatus, as an internal combustion engine and gas compressor, having a rotary valve assembly for controlling intake and exhaust gas. The valve assembly is usable as a substitute for the conventional poppet valves and cam shaft of an internal combustion engine. The valve assembly has a simplified construction which can be readily serviced and maintained. In operation, the valve assembly is usable with high speed engines and gas compressors having relatively high compression ratios. The conventional problem with valve float associated with poppet valves is not present in the rotary valve assembly.

The valve assembly has a housing having a bore open to the combustion chamber of an internal combustion piston engine. Intake and exhaust gas passages located in housing are open to separate portions of the bore. A continuous sleeve having an intake port, an exhaust port, and an ignition hole is located in the bore and secured to the housing. The intake and exhaust ports are aligned with the intake and exhaust gas passages. The sleeve is preferably a cylindrical ceramic member having a cylindrical inner surface. Rotatable valving means having a valving passage open to the combustion chamber and sleeve is located within the sleeve. The valving means includes means having limited lateral movement and a surface engageable with a section of the inner surface of the sleeve to close the intake and exhaust ports. The gas pressure in the combustion chamber operates to laterally move the means of the valving means in sealing relation with respect to the sleeve. In one form of the valve assembly the valving member has a body and a ring surrounding the body. The ring has a valving port aligned with a valving passage in the body. The ring has an inside diameter slightly larger than the body whereby the ring has limited lateral movement relative to the body. The ring is preferably a cylindrical ceramic member having an outer surface engageable with the inner surface of the sleeve. In another form of the valve assembly the valving member is a body having the valving passage on an outer cylindrical surface engageable with the inner surface of the sleeve. A universal coupling drivably connects the body with a drive shaft whereby the body rotates about an axis offset from the axis of rotation of the shaft. This maintains the outer surface of the body in sealing relation with a portion of the inner surface of the sleeve.

When the valve assembly is used as a head for an internal combustion engine or a gas compressor the rotatable valving means is drivably connected to the crankshaft of the engine so that the valving means is rotated in timed relation with respect to movement of the piston. The head is provided with means for generating a spark, such as a sparkplug, to ignite an air/fuel mixture in the combustion chamber. The sleeve is provided with a hole to accommodate the electrodes of the sparkplug. A fuel injector can be mounted on the head in lieu of the sparkplug when the engine is a Diesel engine.

IN THE DRAWINGS

DESCRIPTION OF PREFERRED EMBODIMENTS

Figure 1:
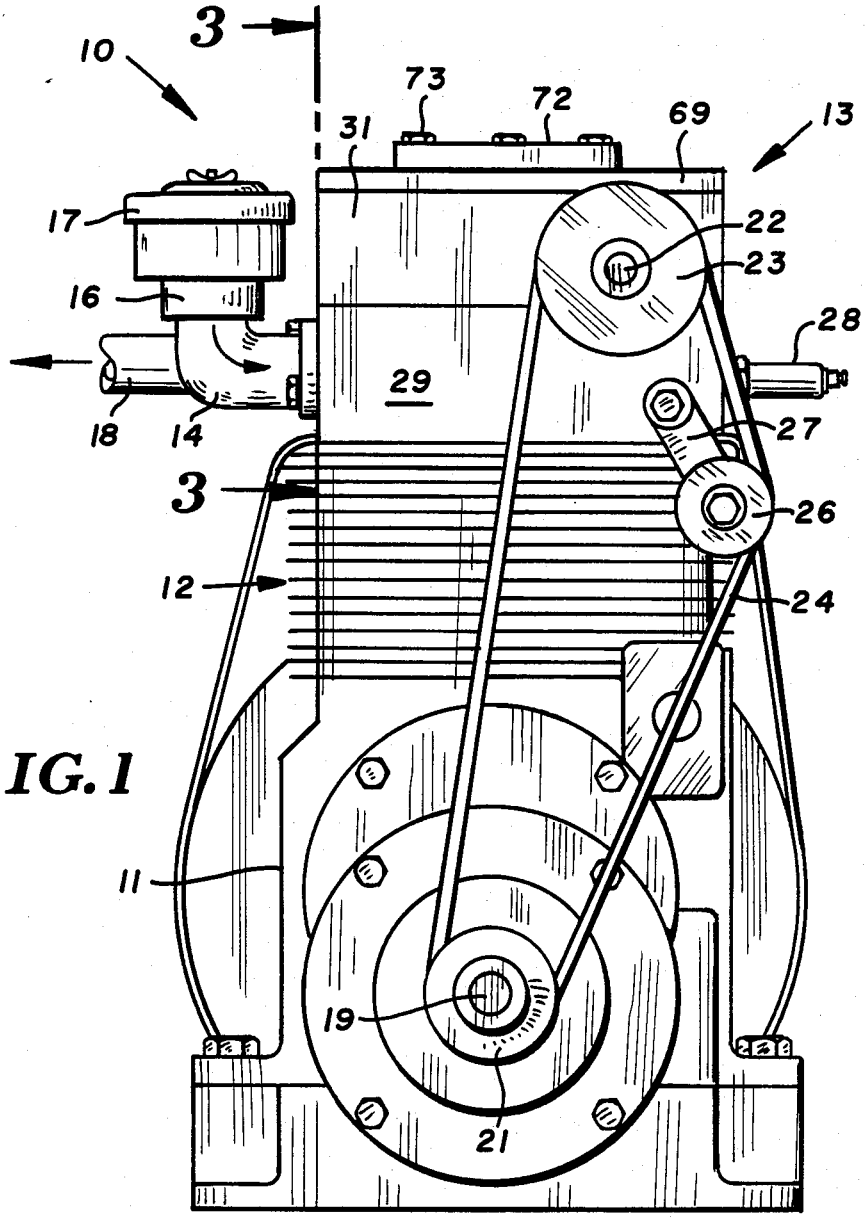
FIG. 1 is an elevational view of an internal combustion engine equipped with the head having a rotary valve of the invention.
Figure 2:
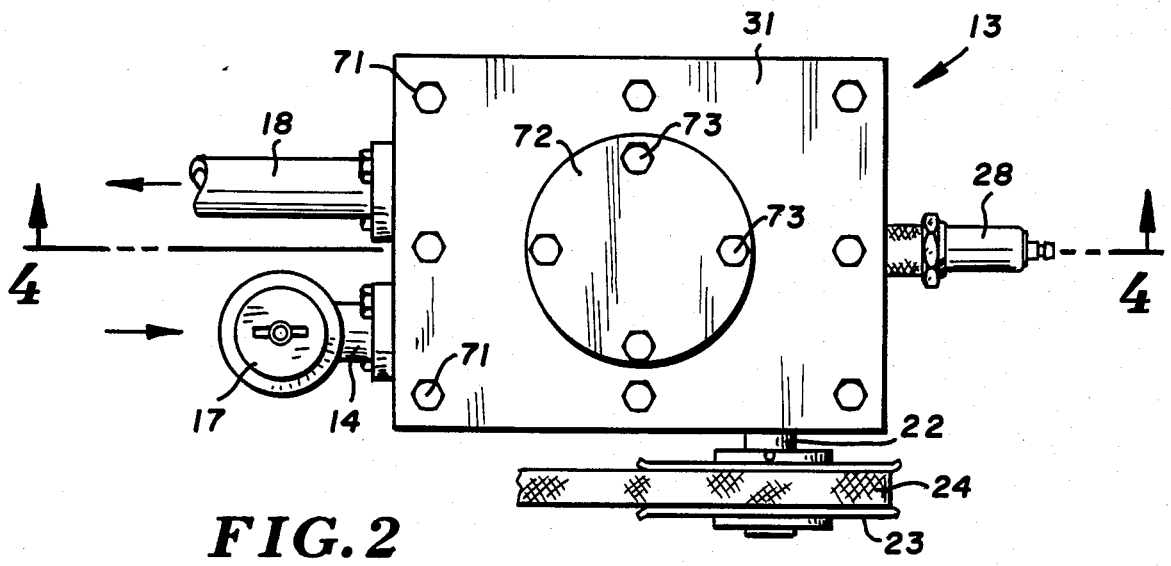
FIG. 2 is a top view of FIG. 1.
Figure 3:
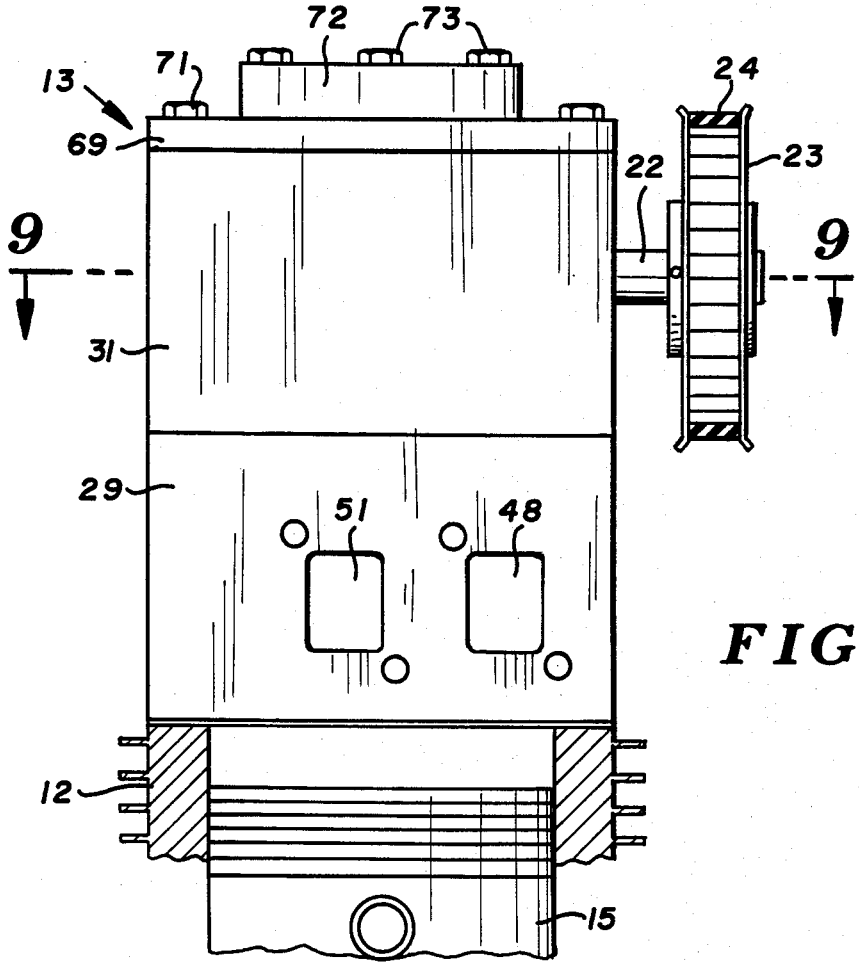
FIG. 3 is a sectional view taken along the line 3—3 of FIG. 1.

Referring to FIGS. 1-3, there is shown an internal combustion engine indicated generally at 10. Engine 10 is a four-cycle single cylinder reciprocating piston engine having a block 11 supporting an upright cylindrical cylinder 12. A piston 15 located in the cylinder bore is operatively connected to a crankshaft 19 with a conventional connecting rod (not shown). A head assembly indicated generally at 13 is mounted on top of cylinder 12. Head assembly 13 supports an intake manifold 14. The inlet of manifold 14 supports a carburetor 16 and an air cleaner 17. An exhaust pipe 18 is secured to the head adjacent manifold 14.

A pulley 21 is mounted on the outer end of crankshaft 19. Head 13 carries a rotating shaft 22 carrying a pulley 23. An endless timing belt 24 operatively connects the pulleys 21 and 23. Timing belt 24 rides over an idler pulley 26 connected to head 13 with an arm 27. Arm 27 is adjustable so that belt 24 can be properly tensioned. Other power transmitting mechanisms, such as gears, can be used to drivably connect crankshaft 19 to shaft 22. Head assembly 13 also supports a sparkplug 28 connected with suitable electrical conductors to the ignition system (not shown) of the engine. The ignition system is a conventional electrical ignition circuit of an internal combustion engine.

Figure 4:
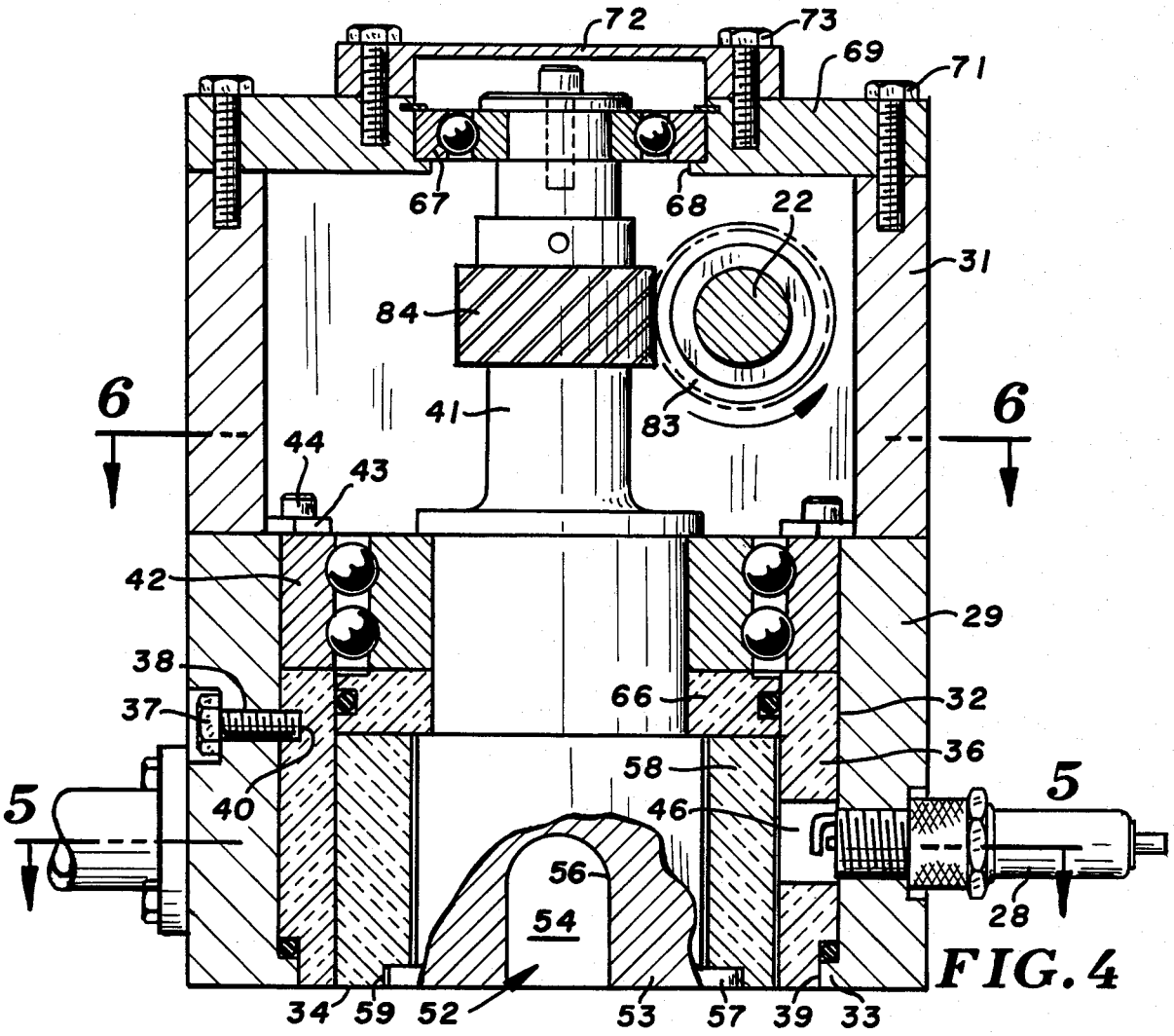
FIG. 4 is an enlarged sectional view taken along the line 4—4 of FIG. 2.
Figure 5:
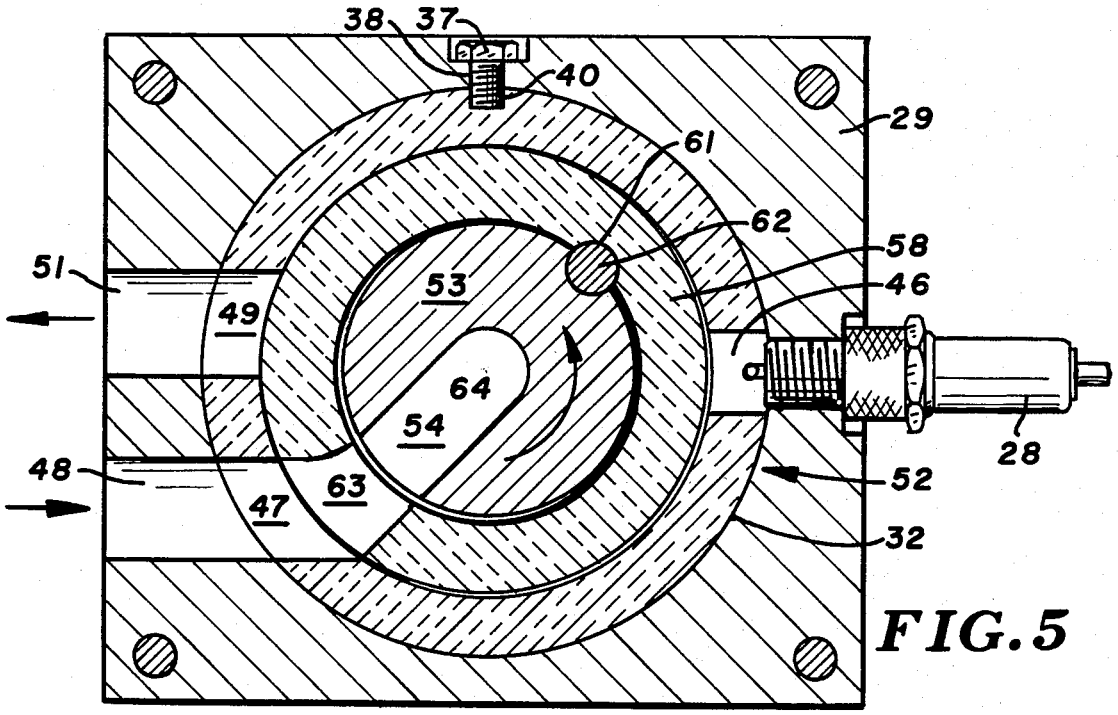
FIG. 5 is a sectional view taken along the line 5—5 of FIG. 4.

As shown in FIGS. 1, 3 and 4, head assembly 13 has a first housing 29 located on top of cylinder 12 and secured thereto with conventional head bolts (not shown). A second housing 31 is mounted on top of first housing 29. Housings 29 and 31 can be a single housing or casing that is mounted on top of cylinder 12. Housing 29, as shown in FIG. 5, has a cylindrical bore 32. The lower end of the bore 32 has an inwardly directed annular continuous lip 33 surrounding an opening 34 facing cylinder 12. A cylindrical sleeve 36 is located in bore 32. As shown in FIG. 5, bolt 37 threaded into a hole 38 extends into a notch in sleeve 36 to fix sleeve 36 to housing 29. The lower end of sleeve 36 has an annular groove or recess 39 accommodating annular lip 33 of housing 29. Sleeve 36 is a cylindrical member having a wall having a substantially uniform thickness. The sleeve is a ceramic material, such as silicon nitride, silicon carbide, or a ceramic including carbon, nitrogen, oxygen, aluminum and other materials.

Figure 6:
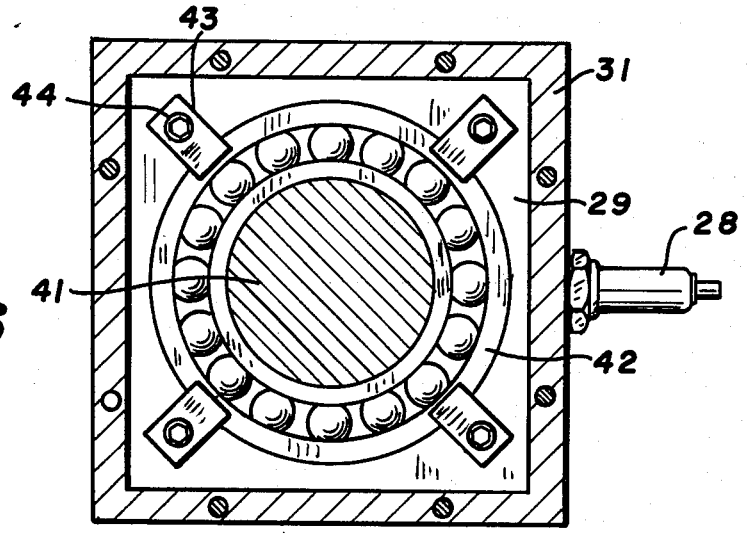
FIG. 6 is a sectional view taken along the line 6—6 of FIG. 4.

A generally upright rotor or shaft 41 is located within housings 29 an 31. The mid-section of rotor 42 is rotatably supported on a bearing 42. Bearing 42 is a ball bearing that fits into the top of bore 32. As shown in FIG. 6, a plurality of ears 43 extend over circumferentially spaced portions of bearing 42. Bolts 44 secure ears 43 to housing 29 so that bearing 42 retains sleeve 46 in housing 29. Sleeve 36 has a hole 46 for accommodating the electrodes of sparkplug 28. Sleeve 36 has an intake port 47 aligned with an intake passage 48 in housing 29. Circumferentially spaced from intake port 47 is an exhaust port 49 aligned with an exhaust passage 51.

Figure 8:
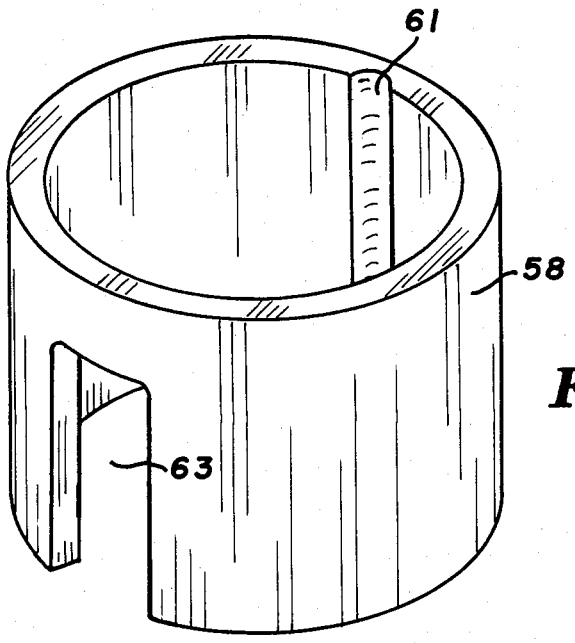
FIG. 8 is an enlarged perspective view of the rotary sleeve of the rotary valve.

A rotary valving unit indicated generally at 52 is located within sleeve 36. Unit 52 comprises a body secured to the lower end of rotor 41. Body 53 has a radial valve passage 54 leading from generally the center of the body to its outer edge and forming therewith an opening 54. The lower end of body 53 has an outwardly directed annular lip 57 providing an annular stop for a ring or second cylindrical sleeve 58. Sleeve 58 has an inwardly directed recess or groove 59 accommodating the annular lip 57. The inside of ring 58 has an upright groove 61 accommodating a key 62. Key 62 drivably connects body 53 with ring 58, whereby ring 58 rotates with body 53 in the direction of the arrow 64. Ring 58 has a valving port 63 aligned with passage 54. Port 63 extends to the bottom of ring 58, as shown in FIG. 8. Ring 58 has an inside diameter that is slightly larger than the outside diameter of body 53 so as to provide the ring with limited lateral movement during rotation thereof with body 53. The lateral movement of the ring 58 allows ring 58 to move into firm bearing relationship with sleeve 36 to seal the exhaust port 49 and intake port 48 during the compression and power strokes of the engine. Ring 58 is made of a ceramic material, such as silicon nitride, silicon carbide, or a ceramic of carbon, silicon, nitrogen, oxygen, aluminum and other materials. A ceramic washer 66 is interposed between bearing 42 and the top of ring 58. Washer 66 spaces the ring 58 from bearing 42 and retains ring 58 in engagement with annular lip 57 thereby preventing axial movement of ring 58 and allowing limited lateral movement of ring relative to body 53.

As shown in FIG. 4, the upper end of rotor 41 is rotatably mounted on a roller bearing 67. Bearing 67 is located in an opening 68 in top plate 69 of housing 31. A plurality of bolts 71 secure top plate 69 to the side wall of housing 31. Bolt 71 can be removed so that top plate 69, as well as rotor 41 and rotary valve assembly 52, can be disassembled from the housings 29 and 31 for servicing and repair. A cap 72 located over bearing 67 and upper end of rotor 41 is secured to top plate 69 with a plurality of bolts 73.

Figure 9:
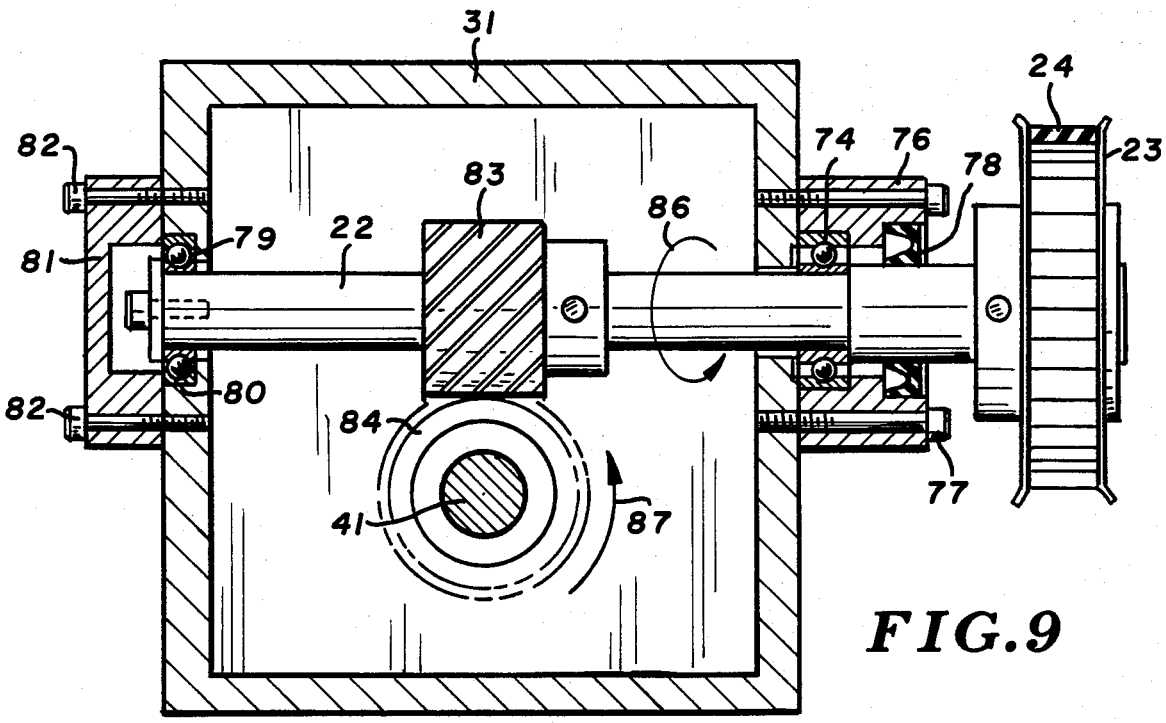
FIG. 9 is a sectional view taken along the line 9—9 of FIG. 3.

Referring to FIG. 9, shaft 22 is rotatably mounted on housing 31 by bearings 74 and 79. Bearings 74 are located within a support or casing 76 secured to the side of housing 31 with a plurality of bolts 77. Bolts 77 accommodate a seal 78 surrounding shaft 22 to prevent escape of oil from inside the housing 31 and foreign matter from entering the housing 31. Bearing 78 is located in an opening 80 and housing 31. A cap 81 holds bearing 79 in the opening 80. A plurality of bolts 82 secure cap 81 to housing 31.

The power is transmitted from shaft 22 to rotor 41 with a gear drive. The gear drive is shown as a helical gear 83 on shaft 22 and a helical gear 84 on rotor 41. The gear 83 has helical teeth located in engagement with the teeth of gear 84, so that on rotation of shaft 22, as indicated by the arrow 86, gear 84 will rotate in the direction of arrow 87. The gear drive can be worm gears drivably interconnecting shaft 22 with rotor 41. The drive ratio between the crankshaft 19 and the rotor 41 is 2 to 1.

In use, when the piston moves down in cylinder 12 in the intake or suction stroke, valve port 63 is located in alignment with intake passage 48, as shown in FIG. 5. The air/fuel mixture flows through passages 48 and 54 into the combustion chamber. When the piston is at bottom dead center, the port 63 is moved to a closed position with respect to intake port 47. During the compression of the air/fuel mixture in the combustion chamber, ring 58 is moved laterally into sealing engagement with the side of sleeve 36 surrounding intake and exhaust ports 47 and 49. This effectively closes the combustion chamber without imparting impact and shock forces on valve body 53 and ring 58. The ceramic ring 58 bearing against the ceramic sleeve 36 provides an efficient seal as the ceramic material has a low coefficient of expansion and functions at high temperatures.

Figure 10:
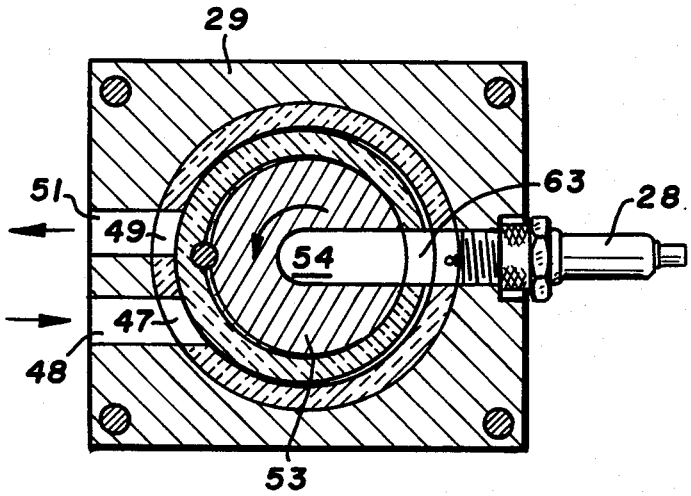
FIG. 10 is a sectional view similar to FIG. 5 showing the rotary valve in the ignition position.

As shown in FIG. 10, valve port 63 has moved into registration with hole 46. The ignition system generates a spark at the electrodes of sparkplug 28 thereby igniting the compressed air/fuel mixture in the combustion chamber. The ignition occurs as the piston approaches the head at top dead center of the crankshaft. The combustion of the air/fuel mixture in the combustion chamber moves the piston downwardly in its power stroke.

Figure 11:
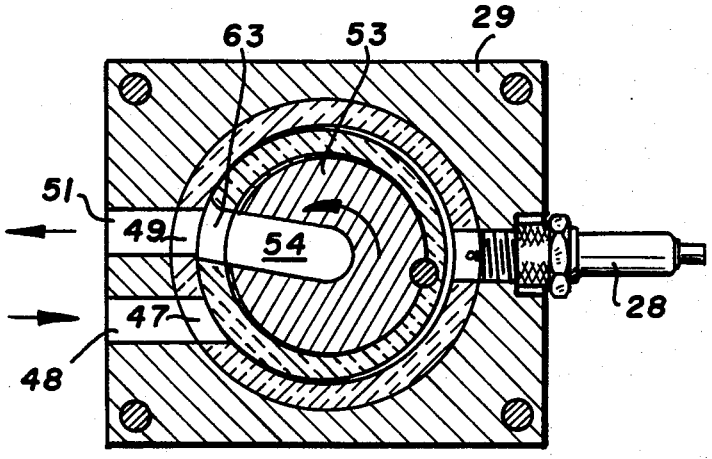
FIG. 11 is a sectional view similar to FIG. 5 showing the rotary valve in the exhaust position.
Figure 7:
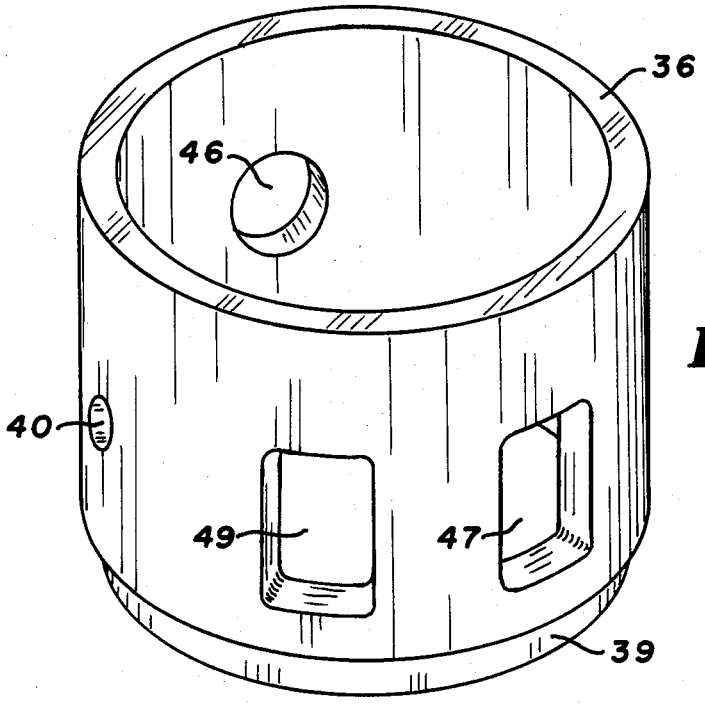
FIG. 7 is an enlarged perspective view of the stationary sleeve of the rotary valve.

On completion of the power stroke, the valve port 63 aligns with exhaust port 49, as shown in FIG. 11, so that the exhaust gas in the combustion chamber is discharged through exhaust passage 51 into exhaust pipe 18. Valve body 53 and ring 58 continue to rotate to the intake port 47 to commence another cycle of operation.

Figure 12:
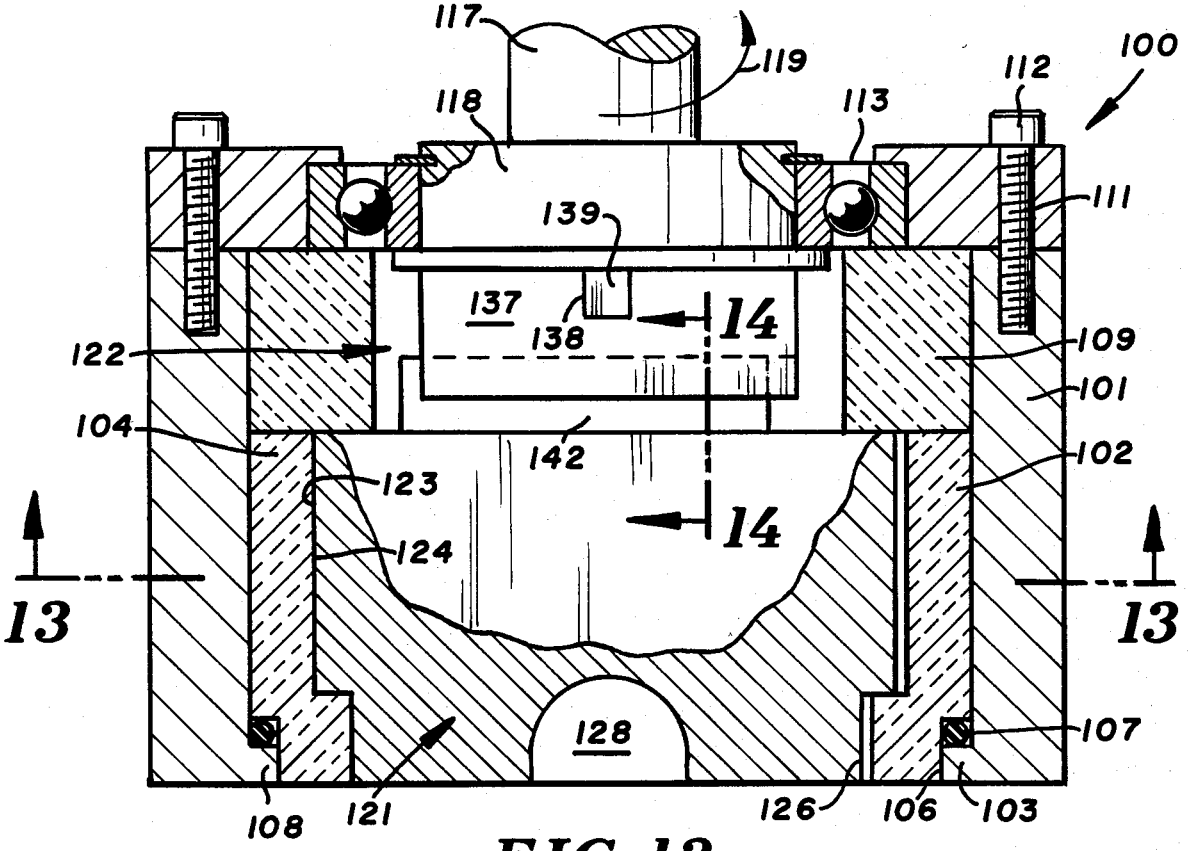
FIG. 12 is a sectional view similar to FIG. 4 of a modification of the rotary valve of the invention.
Figure 13:
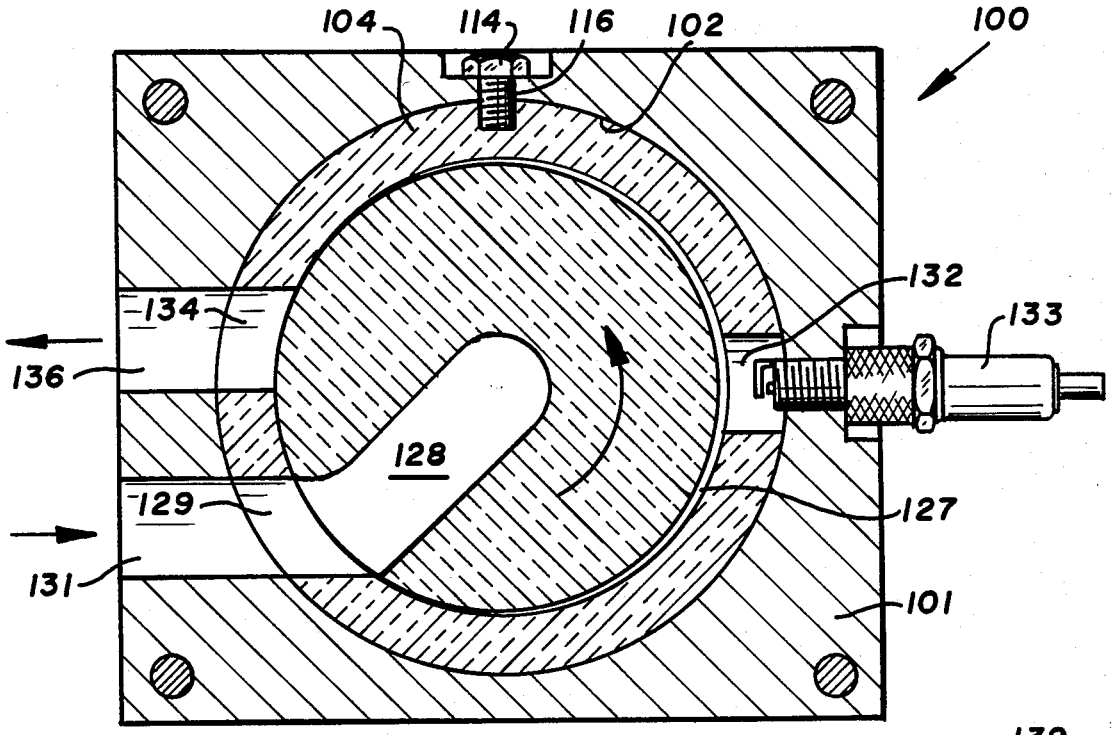
FIG. 13 is a sectional view taken along the line 13—13 of FIG. 12.

Referring to FIGS. 12–15, there is shown a modification of the rotary valve assembly indicated generally at 100. The valve assembly 100 as a housing or casing 101 adapted to be mounted on top of cylinder 12. Housing 101 has an inside cylindrical wall 102 and a lower inwardly directed annular lip 103. A sleeve 104 of ceramic material is located in surface engagement with inside wall 102. The lower end of sleeve 104 has an outer groove 106 accommodating annular lip 103. An annular seal 107 is located between sleeve 104 and lip 103. Sleeve 104 has an inwardly directed annular lip 108 and an upper end engageable with a collar or ring 109. A plate 111 secured to the top of housing 101 with bolts 112 holds ring 109 in engagement with top of sleeve 104. As shown in FIG. 13, a bolt 114 threaded in a hole 116 in housing 111 engages sleeve 104 to prevent rotation of the sleeve 104 in housing 101.

The valve assembly 100 is driven with a rotating shaft 117 having a cylindrical head 118. The head 118 as shown in FIG. 12, is rotatably mounted on roller bearing 113. A gear drive, such as the gear drive shown in FIG. 9, may be used to rotate shaft 117 in the direction of the arrow 119.

A valve body indicated generally at 121 is rotatably positioned in sleeve 104. An Oldham coupling indicated at 122 drivably connects head 118 with valve body 121. Valve body 121 has an axis of rotation that is offset from the axis of rotation of shaft 117. As shown in FIG. 12, body 121 has a cylindrical outer surface 123 located in engagement with inner surface 124 of sleeve 104. Valve body 121 has a diameter that is slightly smaller than the diameter of sleeve 104 so that an arcuate segment of valve body 121 is spaced from a small arcuate gap 127 from a portion of sleeve 104. The lower end of body 121 has an inwardly directed groove 126 accommodating the annular lip 108 of sleeve 104. The upper end of body 121 engages ring 109. Ring 109 restrains axial movement of body 121, but allows free limited lateral movement of body 121 as it rotates relative to sleeve 104. The lower side of body 121 has a radial passage 128 open to the side and bottom of body 121. As shown in FIG. 13, passage 128 is in alignment with an intake port 121 in sleeve 104 and an intake passage 131 in housing 101.

Figure 15:
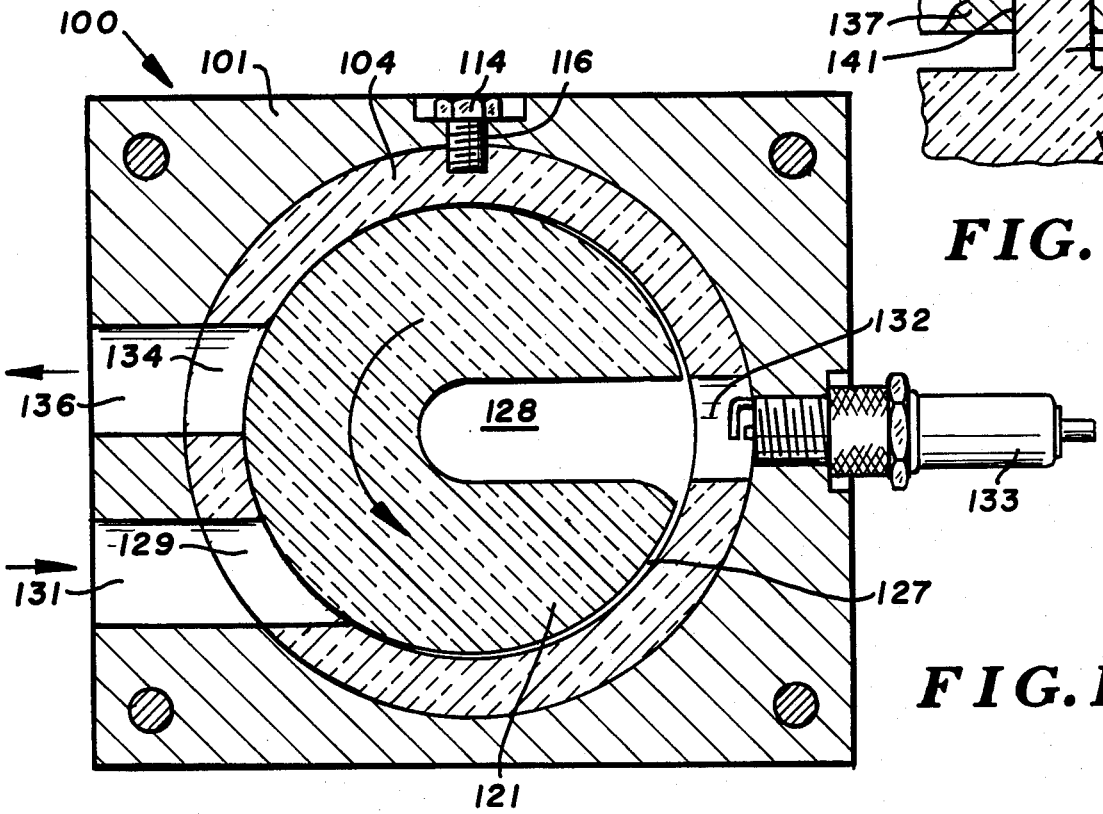
FIG. 15 is a sectional view similar to FIG. 13 showing the rotary valve in the ignition position.

Sleeve 104 has an ignition port 132 in alignment with a sparkplug 133 mounted in housing 101. Body 121 is rotatable to align passage 128 with ignition port 132, as shown in FIG. 15. At this point, the sparkplug ignites the fuel/air mixture in the cylinder to commence the power stroke of the engine.

Sleeve 104 has an exhaust port 134 in alignment with an exhaust passage 131 in housing 101. Exhaust port 134 is located adjacent intake port 129 so that on completion of the exhaust stroke the intake stroke will commence.

Figure 14:
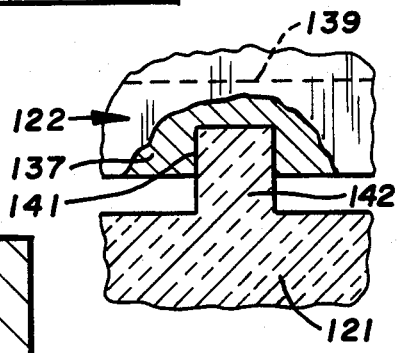
FIG. 14 is an enlarged sectional view taken along the line 14—14 of FIG. 12.

Oldham coupling 122 has a disc 137 located between head 118 and the top of body 121. Disc 137 has a first groove 118 and the top of body 121. Disc 137 has a first groove 138 accommodating a transverse first rib 139 secured to the bottom of head 118. The lower side of disc 137 has a second groove 141 oriented 90 degrees relative to the first groove 138. A linear upwardly directed rib 142 is secured to the top of the body 121 and projects into groove 141, as shown in FIG. 14. Oldham coupling 122 shows one form of universal drive that can be employed to rotate the eccentrically located valve body 121 with shaft 117. Other types of universal joints can be used to effect a drive between shaft 117 and valve body 121.

The rotary valve assembly has been described in association with a head for an internal combustion piston engine. The head with the rotary valve assembly can be used with a piston and cylinder gas compressor to control the flow of gas into and out of the compressor. These uses of the valve assembly of the invention are examples of its utility to control the flow of a fluid. The use of the valve assembly is not limited to the specific uses described herein. The rotary valve assemblies 52 and 100 can be used in Diesel engines. Sparkplugs 28 and 133 are replaced with conventional fuel injectors operable to introduce a charge of fuel into the cylinder chamber when the piston is completing the compression stroke. The compression of the gases in the cylinder chamber ignites the fuel causing the fuel to burn. The fuel burns during the power stroke of the piston. Rings 58 and 104 may be provided with axial grooves connecting ports 46 and 132 directly with the combustion chambers so that the gas in the ports will be at substantially the same pressure as the gas in the combustion chamber.

While there has been shown and described several embodiments of the valving assembly, it is understood that changes in the structures, materials and use thereof may be made by those skilled in the art without departing from the invention.

The embodiments of the invention in which an exclusive property or privilege is claimed are defined as follows:

1. An internal combustion engine comprising: a block having at least one cylindrical wall surrounding a combustion chamber, piston means located in said combustion chamber, operable to reciprocate to piston in said chamber, head means mounted on the block covering said chamber, said head means having an air and fuel intake passage and an exhaust gas passage, a rotary valve assembly operatively associated with the head means for controlling the flow of air and fuel into the chamber and the flow of exhaust gas from the chamber, said head means having a housing with a bore open to the chamber accommodating said valve assembly, said valve assembly comprising a cylindrical sleeve located in said bore, said sleeve having an inner surface, and ignition hole, and intake and exhaust ports aligned with said intake passage and exhaust gas passage, spark generating means mounted on the housing means operable to generate a spark in said hole, rotatable valving means located within said sleeve for controlling the flow of air and fuel into said chamber and the flow of exhaust gases out of the chamber, said rotatable valving means having a valving passage open to the chamber and the inner surface of the sleeve, said rotatable valving means including means having limited lateral movement to maintain a sealing relationship with said inner surface of the sleeve to close said intake and exhaust ports, said means having limited lateral movement is a body having an outer surface engageable with the inner surface of the sleeve, and said body having the valving passage, a drive shaft for rotating said body, and a universal coupling connecting the shaft with the body whereby the body rotates about an axis offset from the axis of the shaft and means operable to rotate said rotatable valving means in timed relation with the movement of the piston means whereby said engine has intake, compression, power, and exhaust strokes.

2. The engine of claim 1 wherein: the body is a ceramic member.

3. The engine of claim 1 including: bearing means mounting the shaft on the housing.

4. The engine of claim 1 including: power transmitting means connecting the rotatable means to the means operable to reciprocate the piston means.

5. The engine of claim 1 wherein: said spark generating means includes a sparkplug mounted on said housing, said sparkplug having electrodes located in said hole of said sleeve.

6. A rotary valve assembly comprising: a housing having a bore, a gas inlet passage and a gas outlet passage open to the bore, a continuous cylindrical sleeve means located in said bore, said sleeve means having an inner surface and ports aligned with said passages, rotatable valving means located within said sleeve means for controlling the flow of gas into and out of assembly, said rotatable valving means having a valving passage open to the combustion chamber and the inner surface of the sleeve means, said rotatable valving means including means having limited lateral movement to maintain a sealing relationship with the inner surface of the sleeve means to close said ports, said means having limited lateral movement is a body having an outer surface engageable with the inner surface of the sleeve means and said valving passage, a drive shaft for rotating said body, and a universal coupling connecting the shaft with the body whereby the body rotates about an axis offset from the axis of the shaft and means operable to rotate said rotatable means whereby said valving passage sequentially moves into alignment with said ports allowing gas to flow into said inlet and outlet gas passages.

7. The assembly of claim 6 wherein: the body is a ceramic member.

8. The assembly of claim 6 including: bearing means mounting the shaft on the housing.

9. The assembly of claim 6 including: power transmitting means connecting the rotatable means to the means operable to reciprocate the piston means.

10. The assembly of claim 6 wherein: said spark generating means includes a sparkplug mounted on said housing, said sparkplug having electrodes located in said hole of said sleeve means.

11. An internal combustion engine comprising: a block having at least one cylindrical wall surrounding a combustion chamber, piston means located in said combustion chamber, means operable to reciprocate the piston means in said chamber, head means mounted on the block covering said chamber, said head means having an air and fuel intake passage, an exhaust gas passage, a rotary valve assembly operatively associated with the head means for controlling the flow of air and fuel into the chamber and the flow of exhaust gas from the chamber, said head means having a housing with a bore open to the chamber accommodating said valve assembly, said valve assembly comprising a cylindrical sleeve located in said bore, said sleeve having an inner surface, an ignition hole, and intake and exhaust ports aligned with said intake passage and exhaust gas passage, spark generating means mounted on the housing means operable to generate a spark in said hole, rotatable valving means located within said sleeve for controlling the flow of air and fuel into said chamber and the flow of exhaust gases out of the chamber, said rotatable valving means having a body and a continuous ring surrounding the body, means connecting the ring to the body whereby the ring rotates with the body, said ring having limited lateral movement relative to said body and an outer surface located adjacent said inner surface of the sleeve whereby when said ring moves into engagement with the inner surface of the sleeve adjacent said intake and exhaust ports, the ring maintains a sealing relationship with the inner surface of the sleeve to close said intake and exhaust ports, said body and ring having valving passages open to the combustion chamber and the inner surface of the sleeve, said body having an outwardly directed lower annular lip, said ring having an annular surface engageable with said lip to limit longitudinal movement of the ring relative to the sleeve, and means operable to rotate said rotatable means in timed relation with the movement of the piston means whereby said engine has intake, compression, power, and exhaust strokes.

12. The engine of claim 11 wherein: the cylindrical sleeve is a ceramic member.

13. The engine of claim 11 wherein: the cylindrical ring is a ceramic member.

14. The engine of claim 11 wherein: the cylindrical sleeve is a first ceramic member having a cylindrical inside wall and the ring is a second ceramic member having an outside wall engageable with the inside wall of the first ceramic member.

15. The engine of claim 11 including: an annular member surrounding said body and engageable with said ring to hold said ring in assembled relation with said body and allowing limited lateral movement of said ring relative to said body.

16. The engine of claim 11 including: bearing means rotatably mounting the body on the housing for rotation along the general longitudinal axis of the piston.

17. A rotary valve assembly comprising: a housing having a bore, a gas inlet passage and a gas outlet passage open to the bore, a continuous cylindrical sleeve means located in said bore, said sleeve means having an inner surface and ports aligned with said passages, rotatable valving means located within said sleeve means for controlling the flow of gas into and out of the assembly, said rotatable valving means having a body and a continuous ring surrounding the body, means connecting the ring to the body whereby the ring rotates with the body, said ring having limited lateral movement relative to said body and an outer surface located adjacent said inner surface of the sleeve means whereby when said ring moves into engagement with the inner surface of the sleeve means adjacent said ports, the ring maintains a sealing relationship with the inner surface of the sleeve means to close said ports, said body and ring having valving passages open to the combustion chamber and the inner surface of the sleeve means, said body having an outwardly directed annular lip, said ring having a annular surface engageable with said lip to limit longitudinal movement of the ring relative to the sleeve means, and means operable to rotate said rotatable valving means whereby said valving passage sequentially moves into alignment with said ports allowing gas to flow in said inlet and outlet gas passages.

18. The assembly of claim 17 wherein: the cylindrical sleeve means is a ceramic member.

19. The assembly of claim 17 wherein: the cylindrical ring is a ceramic member.

20. The assembly of claim 17 wherein: the cylindrical sleeve means is a first ceramic member having a cylindrical inside wall and the ring is a second ceramic member having an outside wall engageable with the inside wall of the first ceramic member.

21. The assembly of claim 17 including: an annular member surrounding said body and engageable with said ring to hold said ring in assembled relation with said body and allowing limited lateral movement of said ring relative to said body.

22. The assembly of claim 17 including: bearing means rotatably mounting the body on the housing for rotation along the general longitudinal axis of the piston.

23. A head for an apparatus having a block, a cylinder having a chamber accommodating a reciprocating piston comprising: housing means having a bore open to the chamber when the housing means is mounted on the cylinder, said housing means having an intake passage and an exhaust passage open to the bore, continuous sleeve means located in said bore, said sleeve means having a cylindrical inside surface, an intake port and an exhaust port, means securing the sleeve means to the housing means to register the intake port with the intake passage and exhaust port with the exhaust passage, rotatable valving means located within said sleeve means, said sleeve means having an inwardly directed lower annular lip, said valving means having a valving passage open to the cylindrical chamber and the inside surface of the sleeve means, and an annular surface engageable with said lip to limit said longitudinal movement of the valving means relative to the sleeve means, said valving means including means having limited lateral movement whereby the valving means engages the inside surface of the sleeve means to close the intake port and exhaust port, and means for rotating said valving means in timed relation with respect to the movement of the piston whereby said valving passage sequentially moves into alignment with the intake port and exhaust port so that gas is moved into and out of the chamber in response to the reciprocal movement of the piston.

24. The head of claim 23 wherein: said sleeve means includes an ignition hole, and spark generating means mounted on the housing means operable to generate a spark in said hole.

25. The head of claim 23 wherein: the sleeve means is a cylindrical ceramic member.

26. The head of claim 23 including: bearing means rotatably mounting the rotatable valving means on said housing means for rotation along the general longitudinal axis of the piston.

27. The head of claim 23 including: power transmission means operably mounted on the head means adapted to be connected to means for reciprocating the piston whereby the valving means rotates in a timed relation with respect to movement of said piston.

28. The head of claim 23 including: an annular member engageable with said valving means to hold said valving means in assembled relation with said housing means and allowing limited lateral movement of said valving means relative to said housing means.

29. The head of claim 23 wherein: said valving means includes a body means, and means drivably coupled to said body means to maintain the sealing relationship between the valving means and the inner surface of the sleeve means adjacent said ports in the sleeve means.

* * * * *